US006715334B2

(12) United States Patent
Kimura et al.

(10) Patent No.: US 6,715,334 B2
(45) Date of Patent: Apr. 6, 2004

(54) APPARATUS AND METHOD FOR MANUFACTURING THICK-WALLED BENT PIPE

(75) Inventors: Yoichi Kimura, Tokyo (JP); Hiroyasu Fukushima, Tokyo (JP)

(73) Assignee: Tokiwa Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/987,903

(22) Filed: Nov. 16, 2001

(65) Prior Publication Data

US 2002/0129636 A1 Sep. 19, 2002

(30) Foreign Application Priority Data

Mar. 16, 2001 (JP) ..... 2001-075952

(51) Int. Cl.[7] ..... B21D 7/04
(52) U.S. Cl. ..... 72/389.8; 73/383; 73/387
(58) Field of Search ..... 73/369, 387, 383, 73/389.8, 386, 389.9, 212, 213

(56) References Cited

U.S. PATENT DOCUMENTS

| | | | | | |
|---|---|---|---|---|---|
| 2,884,987 | A | * | 5/1959 | Shaw | 72/383 |
| 3,306,093 | A | * | 2/1967 | Sassak | 72/389.8 |
| 3,595,061 | A | * | 7/1971 | Bessho | 72/381 |
| 3,869,776 | A | * | 3/1975 | Moshnin et al. | 29/890.149 |
| 5,007,278 | A | * | 4/1991 | Haberstock | 72/383 |
| 6,173,599 | B1 | * | 1/2001 | Stepanenko et al. | 72/383 |
| 6,450,001 | B1 | * | 9/2002 | Kimura | 72/389.8 |
| 6,460,395 | B1 | * | 10/2002 | Courtney et al. | 72/387 |

FOREIGN PATENT DOCUMENTS

| | | | | |
|---|---|---|---|---|
| DE | 3150426 A1 | * | 7/1983 | B21D/9/08 |
| GB | 2122521 A | * | 1/1984 | B21D/7/04 |
| JP | 49-129667 | | 12/1974 | |
| JP | 50-102562 | | 8/1975 | |
| JP | 51-143561 | | 12/1976 | |
| JP | 2000-343136 | | 12/2000 | |

OTHER PUBLICATIONS

Translation (related portion) of Office Action issued in the corresponding Japanese Application dated Oct. 21, 2003.

* cited by examiner

*Primary Examiner*—Allen Ostrager
*Assistant Examiner*—John S Goetz
(74) *Attorney, Agent, or Firm*—Armstrong, Kratz, Quintos, Hanson & Brooks, LLP.

(57) ABSTRACT

An apparatus and a method for manufacturing a thick-walled bent pipe with a simple structure at low production cost, which has durability and can manufacture an elbow material for piping with higher size accuracy, are provided. For this purpose, the manufacturing apparatus is a manufacturing apparatus comprising a presser die (12) and a lower die (20), in which the lower die (20) includes a pair of bottom dies (21, 22) having meshing means (30), and a pair of the bottom dies (21, 22) are allowed to rotate opposite to each other by the meshing means (30), in connection with a descent of the presser die.

6 Claims, 15 Drawing Sheets

APPARATUS AND METHOD FOR MANUFACTURING THICK-WALLED BENT PIPE

TECHNICAL FIELD

The present invention relates to an apparatus and a method for manufacturing a thick-walled bent pipe.

BACKGROUND ART

As for a metal elbow for piping, those with an elbow body 111 being attached to a piping block 113 or the like with a fastening nut 112 as shown in FIG. 11 is used conventionally. Both ends of the elbow body 111 are threaded, and one thread is screwed into the piping block 113 or the like and fastened with the nut 112, while a pipe not shown is attached to the other thread. The elbow body 111 can be freely oriented to the piping and fixed by being fastened with the nut 112. The elbow body 111 is provided with parallel plane portions 111*s* and 111*s* so that the elbow body 111 can be fixed with a spanner or the like when it is attached. Further, the elbow body 111 is bent at substantially 90 degrees, which reduces the protruding amount from the piping block 113 or the like, thus requiring less piping space.

In a section of the elbow body 111, two fluid paths 111*d* and 111*d* cross each other at substantially 90 degrees as shown in FIG. 12. Further, since the elbow needs to be threaded, a margin to cut needs to be secured, which makes a material for the elbow thick-walled. In addition, it is necessary to secure pressure resistance of an elbow in order to respond to high-pressurization of the fluid devices in recent years, and the wall thickness of the elbow body 111 after being worked becomes larger.

Accordingly, it is difficult to manufacture the elbow body 111 as shown in FIG. 12 by bending a thick-walled metal pipe at a small radius, because the pipe is crushed or the wall thickness of the pipe is reduced. Consequently, a material of the elbow is made by cutting out a thick metal plate and forming it into a right-angle elbow, then the material is drilled from both sides thereof to make the fluid paths 111*d* and 111*d* crossing each other at substantially 90 degrees, and thereafter screw thread cutting is performed for both ends to thereby manufacture the elbow body 111.

However, in the above manufacturing method, the process of cutting the material includes two drilling operations and two screw thread cutting operations, which results in too many working steps, and thus the number of steps of preparing the material is large. Further, in the drilling work, burrs caused by the drilling work occur at a crossing portion of the fluid paths 111*d* and 111*d* crossing each other at substantially 90 degrees. Thus, an operation of removing the burrs has to be performed, and the deburring operation is not easy and takes time, since burrs in the inner parts of small holes have to be removed. Further, many cutting operations increase cutting amount of the material, thus reducing yields. Consequently, manufacturing cost is increased.

As a solution to the above disadvantages, an apparatus for manufacturing a thick-walled bent pipe described in Japanese Patent Application Laid-open No. 2000-343136 is proposed. This apparatus includes an upper die 210 having a presser die 212 and an upper guide 211 having a guide surface 211*a* in a circular arc form for guiding a pair of lower dies 221 and 222, as shown in FIG. 10. The apparatus also includes a pair of lower dies 221 and 222 having sliding plane 220*c* and 220*c* in a circular arc form, and a lower guide 230 having sliding planes 230*a* and 230*a* for mounting a pair of the lower dies 221 and 222 thereon. In connection with a descent of the upper die 210, the sliding planes 220*c* and 220*c* in the circular arc form of a pair of lower dies 221 and 222 abut to and slide along the guide surface 211*a* in the circular arc form of the upper guide 211 of the upper die 210. At the same time as this, lower end portions 220*f* and 220*f* of a pair of the lower dies 221 and 221 abut to and slide along the sliding planes 230*a* and 230*a* of the lower guide 230. Sliding in this manner makes the structure in which a pair of the blower dies 221 and 222 are respectively rotatable opposite to each other.

According to this apparatus, a pair of the lower dies 221 and 222 rotate along the guide surface 211*a* in the circular arc form of the upper die 210, having a center of rotation O1 while they are facing to each other. Thereby, changes in the distances between both the end surfaces of the thick-walled pipe material 111*a* and the center O1 of rotation at the start of bending and at the completion of bending are reduced, thus making it possible to form a thick-walled elbow material that is a thick-walled bent pipe with less variations in size.

As a result, the thick-walled pipe can be cut and used as an elbow material, thus making it unnecessary to prepare a forged material. Further, since a thick-walled pipe can be used, drilling for making slender holes to form fluid passages is unnecessary. Further, deburring at the crossing portion of the drilled holes, which is conventionally performed, is made unnecessary. Furthermore, since the thick-walled pipe is round in the outer shape, the margin to cut for screw thread cutting is reduced. Accordingly, a special drill is not needed, drilling work and deburring work are not needed, and cutting amount for screw threading work is reduced, whereby the time required for work, and tool cost can be substantially reduced, and the yield of the material can be improved.

However, since the upper guide 211 of this apparatus has the guide surface 211*a* in the circular arc form, the guide surface 211*a* in the circular arc form has to be worked by cutting a block to produce the upper guide 211, which requires a large amount of work and makes the work complicated, and as a result, work cost becomes high. Since the upper guide 211 is in a block form, it has heavy weight, which is inconvenient in handling. Further, the sliding surfaces 220*c* and 220*c* in the circular arc form of a pair of the lower dies 221 and 222 abut to and slide along the guide surfaces 211*a* in the circular arc form of the upper guide 211 of the upper die 210, and thus the sliding surfaces 220*c* and 220*c* and the guide surfaces 211*a* in the circular form are worn or seize if they are used for a long period of time.

SUMMARY OF THE INVENTION

The present invention is made in view of the above-described disadvantages, and its object is to provide an apparatus for manufacturing a thick-walled bent pipe with a simple structure at low manufacture cost, which has durability and is capable of manufacturing an elbow material for piping with higher size accuracy with use of a thick-walled pipe material, and a method of manufacturing a thick-walled bent pipe with use of the manufacturing apparatus.

In order to attain the above object, the apparatus for manufacturing a thick-walled bent pipe according to the present invention is an apparatus for manufacturing a thick-walled bent pipe comprising a presser die and a lower die, and has the constitution in which the lower die comprises a pair of bottom dies having meshing means and a pair of the bottom dies are allowed to rotate opposite to each other by meshing means, in connection with a descent of the presser die.

According to the above constitution, the apparatus for manufacturing a thick-walled bent pipe has a simple structure, and therefore it has durability at low production cost. In addition, it can manufacture thick-walled elbow materials with high size accuracy.

Further, in the apparatus for manufacturing the thick-walled bent pipe, a pair of the bottom dies may be provided with stoppers abutting to both end surfaces in a longitudinal direction of a material to be formed.

According to the above constitution, bending work is performed with the thick-walled pipe material being restrained so as to have a set length by the presser die, the lower die and the stoppers of the lower die, thus making it possible to form a thick-walled elbow material of an accurate size.

The apparatus for manufacturing the thick-walled bent pipe may further comprise side press devices for pressing side surfaces of a material to be formed.

According to the above constitution, the side press devices press the side surfaces of the thick-walled pipe material, and therefore flat surface portions to which a wrench can be applied can be formed on both sides of a center portion of the thick-walled pipe material.

The method for manufacturing a thick-walled bent pipe according to the present invention is a method for manufacturing a thick-walled bent pipe comprising the steps of placing a thick-walled metal pipe material of a predetermined length on a lower die comprising a pair of bottom dies having meshing means, and pressing a middle portion in a longitudinal direction of the thick-walled metal pipe material by lowering a presser die, and thereby rotating a pair of the bottom dies opposite to each other by the meshing means to form a thick-walled elbow material of a predetermine size.

According to the above constitution, since the manufacturing apparatus having durability with a simple structure at low production cost is used, and thus a thick-walled elbow material with high size accuracy with use of a thick-walled pipe material can be manufactured at lower cost.

Further, the method for manufacturing the thick-walled bent pipe may further comprises the step of on pressing the middle portion in the longitudinal direction of the thick-walled metal pipe material, making stoppers provided at a pair of the bottom dies abut to both end surfaces in the longitudinal direction of the thick-walled metal pipe material to restrain both the end surfaces in the longitudinal direction of the thick-walled metal pipe material.

According to the above constitution, the thick-walled pipe material is restrained and bent so as to be in a set size by the presser die, the lower die and the stoppers of the lower die, and thus a thick-walled elbow material of an accurate size can be formed.

BRIEF DESCRIPTION OF THE DRAWINGS

FIG. 4A is a view showing the positional relationship from the front, FIG. 4B is a plan view of the positional relationship in FIG. 4A seen from the above, and FIG. 4C is a side view of the positional relationship in FIG. 4A seen from the left;

FIG. 6A shows a thick-walled pipe material before being formed, and FIG. 6B shows a thick-walled elbow material after being formed;

FIG. 7A shows a state in which a pipe material is placed on a lower die, FIG. 7B shows a state in which a protruded portion of a presser die abuts to a middle portion in a longitudinal direction of the pipe material, FIG. 7C shows a state in which a ram is further lowered to lower the presser die, FIG. 7D shows a state in which lower surfaces of the bottom dies abut to an upper surface of a base frame, and FIG. 7E shows a state in which the ram is raised to raise the presser die;

BEST MODE FOR CARRYING OUT THE INVENTION

Preferred embodiments according to the present invention will be explained below with reference to the drawings.

Figure 1:
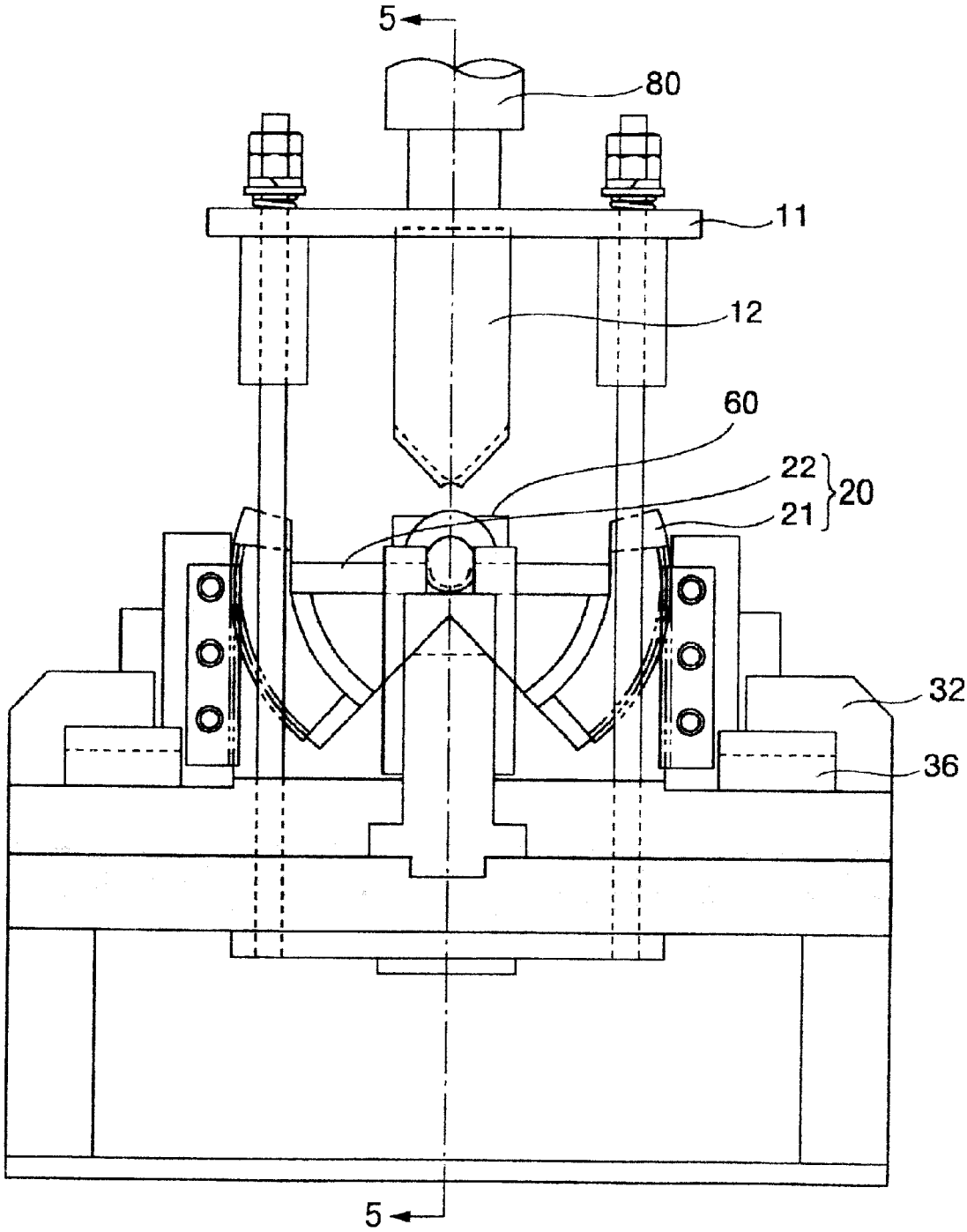
FIG. 1 is a front view showing an apparatus for manufacturing a thick-walled bent pipe according to an embodiment of the present invention.
Figure 2:
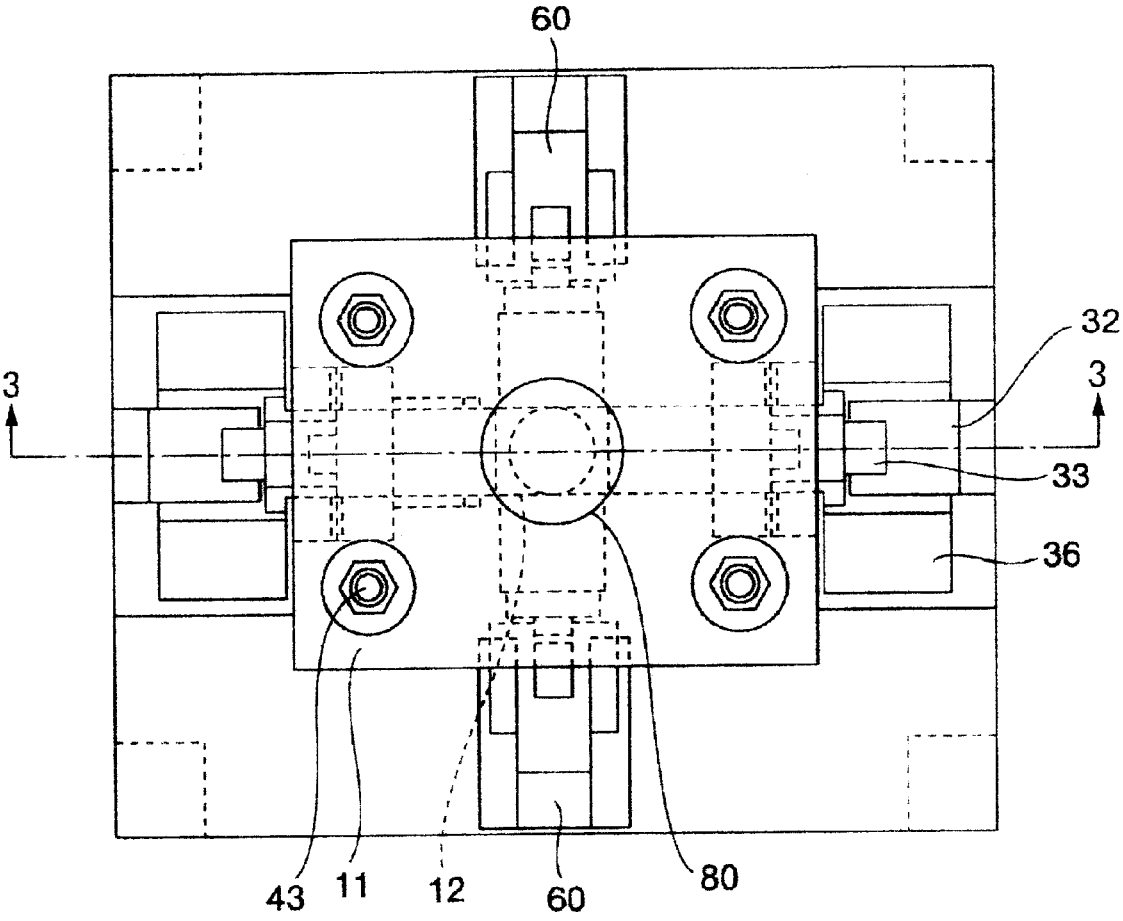
FIG. 2 is a plan view of the apparatus for manufacturing the thick-walled bent pipe in FIG. 1.
Figure 3:
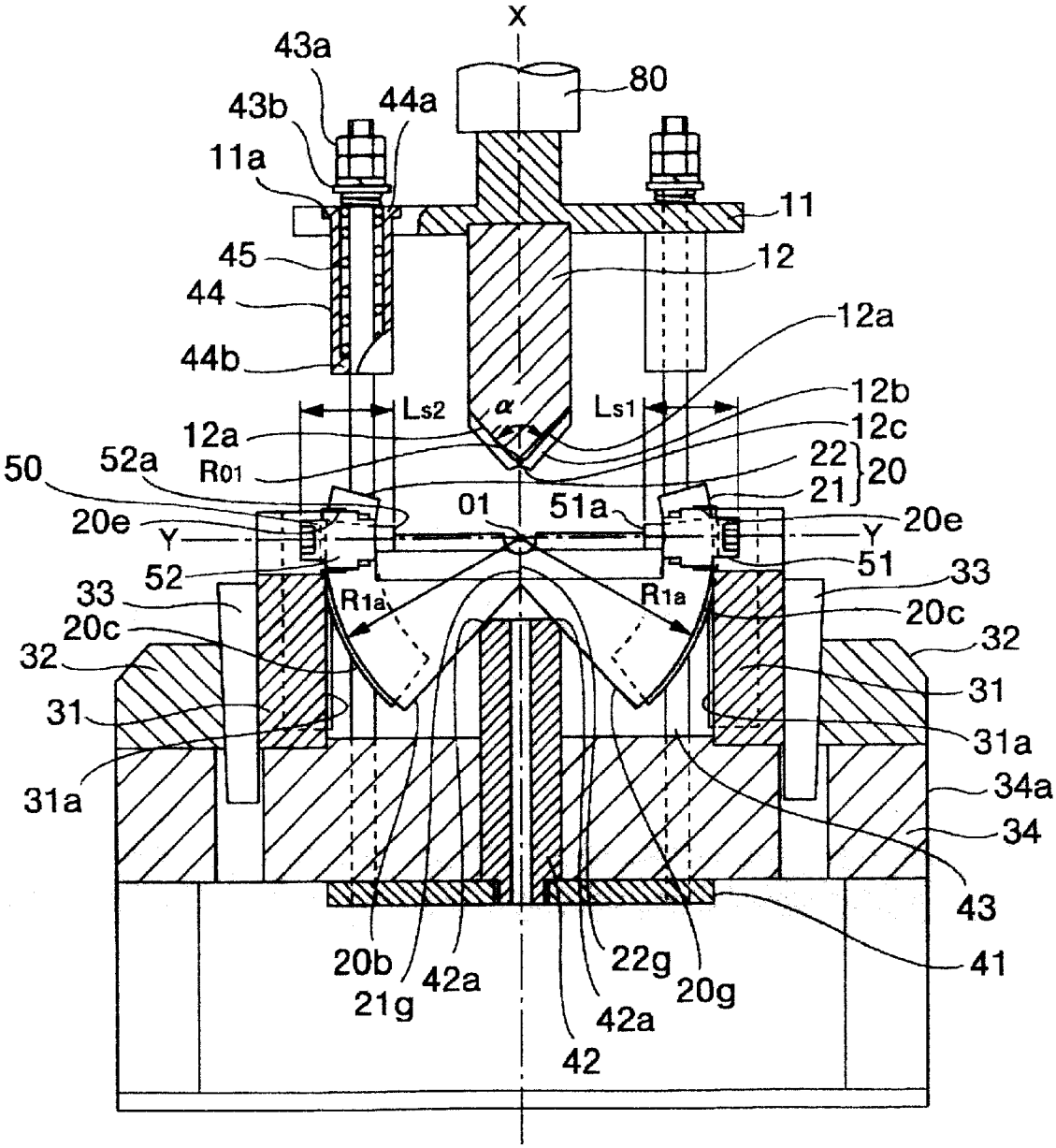
FIG. 3 is a sectional view taken along the line 3—3 in FIG. 2.
Figure 4A:
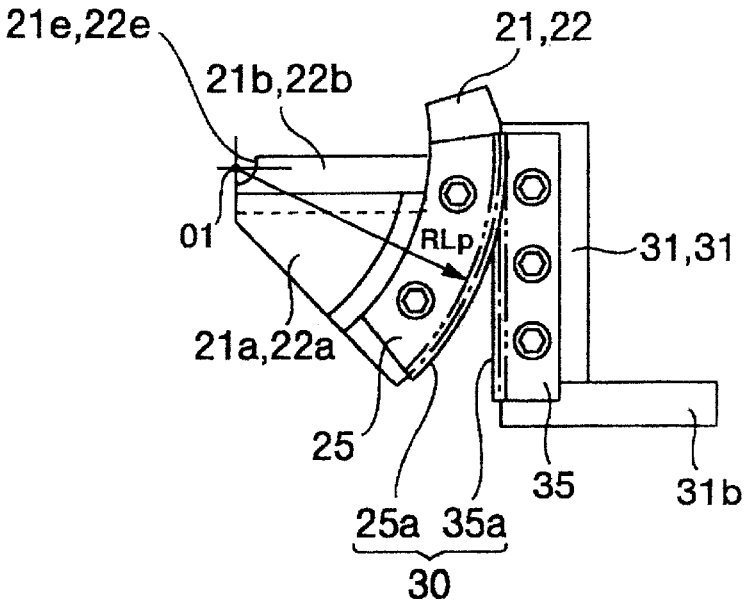
FIG. 4A through FIG. 4C show positional relationship between a pair of bottom dies and a guide block according to the embodiment.
Figure 4B:
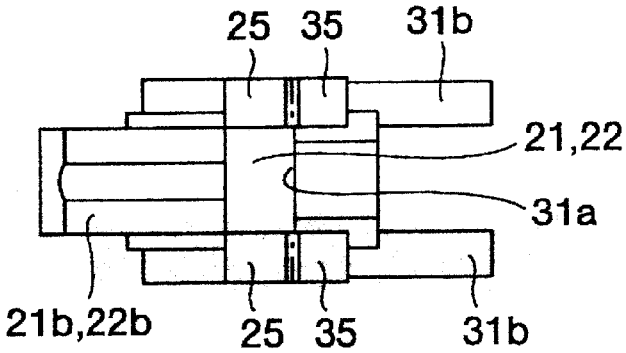
Figure 4C:
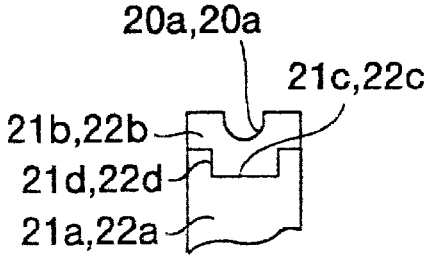
Figure 5:
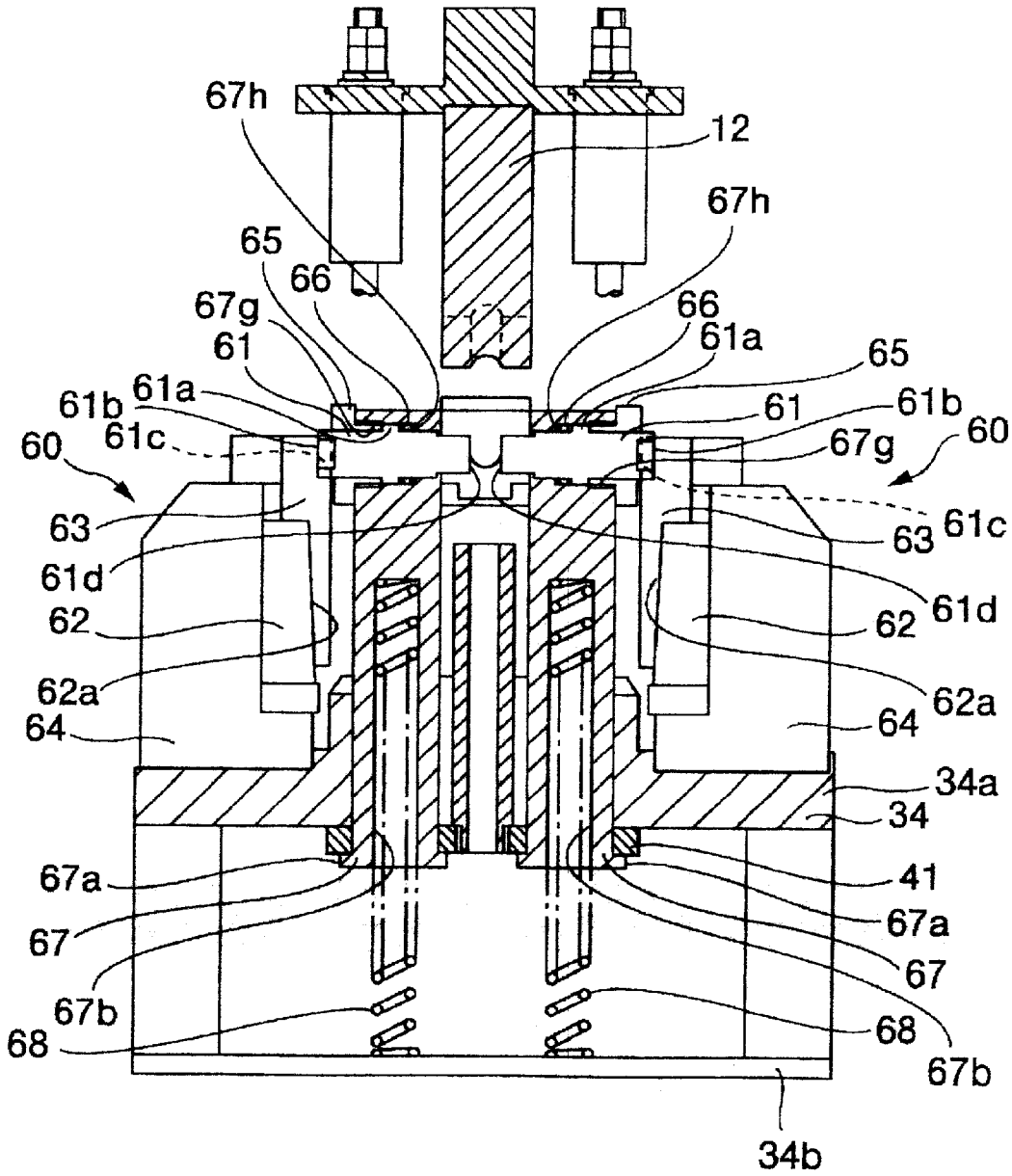
FIG. 5 is a sectional view taken along the line 5—5 in FIG. 1.

FIG. 1 is a front view of an apparatus for manufacturing a thick-walled bent pipe. FIG. 2 is a plan view of FIG. 1 seen from above. FIG. 3 is a sectional view taken along the line 3—3 in FIG. 2. FIG. 4A through FIG. 4C are views showing positional relationship between a pair of bottom dies 21 and 22 and guide blocks 31 and 31. FIG. 5 is a sectional view taken along the line 5—5 in FIG. 1.

A presser die 12 is attached to a presser die mounting plate 11 with a bolt not shown. The presser die mounting plate 11 is attached at a lower end of a ram 80 such as a press to be ascendable and descendable. As shown in FIG. 3, in a protruded portion 12*b* provided at a lower end portion of the presser die 12, grooves 12*a* and 12*a* in a circular arc form in section, which conform to an outer shape of a thick-walled elbow material 111*b* that will be described later, are symmetrically provided on both sides of the vertical center line X. The grooves 12*a* and 12*a* in the circular arc form in section are connectingly formed at an angle α corresponding to a bent angle of the thick-walled elbow material 111*b*, for example, 90 degrees, with a tip end portion of the protruded portion 12*b* as the vertex. An R surface with the radius of R01, for example, 2 mm, which is so small that it gives no flaw on the thick-walled elbow material 111*b* during the forming of it, is formed at top portions of the grooves 12*a* and 12*a* in the circular arc form in section. A notch portion 12*c* in a circular arc form is provided at the lower end portion of the presser die 12 so as to avoid interference with side press devices 60 provided in front of and at the rear of the presser die 12 as shown in FIG. 2.

As shown in FIG. 3, the lower die 20 has a pair of bottom dies 21 and 22. The pair of bottom dies 21 and 22 are substantially in a sector form, and respective end faces 21*g* and 22*g* abut to each other on the vertical center line X. The pair of bottom dies 21 and 22 are provided with rolling surfaces 20*c* and 20*c* in a circular arc form with radiuses R1*a* and R1*a* both having center O1 on the vertical center line X. The center O1 is on a center line YY in an axial direction of a thick-walled pipe material 11*a* that will be described later.

The rolling surfaces 20*c* and 20*c* in the circular arc form abut to guide surfaces 31*a* and 31*a* of guide blocks 31 and 31. FIG. 4A is a front view showing positional relationship between a pair of the bottom dies 21 and 22 and the guide blocks 31 and 31. FIG. 4B is a plan view of FIG. 4A seen from above. FIG. 4C is a side view of FIG. 4A seen from the left. Circular arc racks 25 and 25 are attached to both sides of rolling surfaces 20*c* and 20*c* in the circular arc form of a pair of the bottom dies 21 and 22 by means of bolts not shown. The circular arc racks 25 and 25 have circular arc rack portions 25*a* with teeth being formed thereon, and are in a form of part of gear taken out. A center of a pitch radius RLp of the circular arc rack portions 25*a* of the circular arc racks 25 and 25 is the aforementioned center O1 on the vertical center line X. The center O1 is on the axial center line YY of the thick-walled pipe material 111*a*. Straight-line racks 35 and 35 are attached on both sides of the guide surfaces 31*a* of the guide blocks 31 and 31 by means of bolts not shown. The straight-line racks 35 and 35 have straight-line rack portions 35*a* with teeth being formed thereon. The teeth of the circular arc rack portion 25*a* and the teeth of the straight-line rack portion 35*a* may be claws and chains, or may be in any form if only they are meshed with each other. In this manner, the circular arc racks 25 and 25 and the straight-line racks 35 and 35 define meshing means 30 in which they are meshed with each other. As a result, even if a pair of bottom dies 21 and 22 rotate opposite to each other so as to approach the vertical center line X, the center of the pitch radius RLp of the circular arc rack portions 25*a* of the circular arc racks 25 and 25 is the center O1 of the vertical center line X. Accordingly, the center O1 moves on the vertical center line X.

The circular arc racks 25 and 25 and the straight-line racks 35 and 35 being the meshing means 30 can be manufactured by working a plate, which requires less work amount. Accordingly, the manufacturing cost is reduced. The circular arc racks 25 and 25 and the straight-line racks 35 and 35 in a plated form are only attached to the bottom dies 21 and 22 and the guide blocks 31 and 31, thus simplifying the structure. Further, the circular arc racks 25 and 25 and the straight-line racks 35 and 35 in the plate form are light in weight, thus facilitating handling. The circular arc racks 25 and 25 and the straight-line racks 35 and 35 are meshed in their teeth, and thus they have no sliding portions and is hardly worn or seize, thus increasing durability.

As shown in FIG. 4A through FIG. 4C, a pair of the bottom dies 21 and 22 are defined by lower die main body portions 21*a* and 22*a* and pipe dies 21*b* and 22*b*. At upper portions of a pair of the bottom dies 21 and 22, the pipe dies 21*b* and 22*b* provided with grooves 20*a* and 20*a* in a circular arc form conforming to the outer shape of the thick-walled elbow materials 111*b* after being formed are provided with raised portions 21*d* and 22*d* of the pipe dies 21*b* and 22*b* being fitted into groove portions 21*c* and 22*c* of the lower die main body portions 21*a* and 22*a*. Notch portions 21*e* and 22*e* in a circular arc form are provided at end portions of the pipe dies 21*b* and 22*b* so as to avoid interference with the side press devices 60 provided in front of and at the rear of the upper guide 11.

The guide blocks 31 and 31 are fixed by being pressed toward the vertical center line X by taper pins 33 and 33 inserted between blocks 32 and 32 fixed to a base frame 34 with bolts not shown. The guide blocks 31 and 31 are in a L-shape in the front view of FIG. 4A, and lower portions 31*b* of the guide blocks 31 and 31 extend horizontally to be away from the guide surfaces 31*a*. Slide guides 36 fixed to the base frame 34 with bolts not shown abut to top surfaces of the lower portions 31*b*. By removing the taper pins 33 and 33 shown in FIG. 3, the lower portions 31*b* of the guide blocks 31 and 31 slide along the slide guides 36 and the guide blocks 31 and 31 can move in a direction to be away from the vertical center line X. Accordingly, by removing the taper pins 33 and 33, a pair of the bottom dies 21 and 22 move away from the guide blocks 31 and 31, and mesh of the circular arc racks 25 and 25 and the straight-line racks 35 and 35 being the meshing means 30 is released, whereby a pair of the bottom dies 21 and 22 can be easily removed.

Holes 20*e* and 20*e* for inserting a first stopper 51 and a second stopper 52 for abutting end surfaces of the placed thick-walled pipe material 111*a* are provided at end portions on an extended line of the grooves 20*a* and 20*a* at the upper portion of a pair of the bottom dies 21 and 22. The holes 20*e* and 20*e* are provided with threads, which are meshed with threaded portions of the first stopper 51 and the second stopper 52, and the first stopper 51 and the second stopper 52 can move in a longitudinal direction by being rotated. A stopper 50 has the first stopper 51 and the second stopper 52. One end surfaces of the first stopper 51 and the second stopper 52 are planar end surfaces 51*a* and 52*a*.

Lengths Ls1 and Ls2 of the first stopper 51 and the second stopper 52 are determined so that horizontal positions of the planar end surfaces 51*a* and 52*a* from the vertical center line X are at predetermined positions according to sizes LE1 and LE2 of the thick-walled elbow material 111*b* after being formed. As for the stopper 50, the same end surfaces as the aforementioned planar end surfaces 51*a* and 52*a* may be integrally formed at a pair of the bottom dies 21 and 22.

A support plate 41 is placed under a base plate 34*a* of the base frame 34. A bottom support 42 is mounted on a top surface of a center portion of the support plate 41 with a screw at a bottom portion thereof, and the bottom support 42 penetrates through the base plate 34*a* to be vertically slidable and protrudes above the base plate 34*a*. The support plate 41 is a rectangular plate, and support rods 43 are fixed to four corner portions thereof. Four support rods 43 penetrate through the base plate 34*a* to be vertically slidable, protrude above the base plate 34*a*, and further penetrate through four corner portions of a rectangular plate part of the presser die mounting plate 11.

Spring cylinders 44 are placed in the four corner portions of the rectangular plate part of the presser die mounting plate 11. Flanges 44*a* are provided each on an upper periphery portion of the spring cylinder 44, which fit into stepped holes 11*a* at the four corner portions of the rectangular plate part of the presser die mounting plate 11 to be prevented from falling off. Spring bearing portions 44*b* are provided each in a lower portion of the spring cylinder 44 to bear a support spring 45.

The support rod 43 penetrates through a hole at the bottom of the spring cylinder 44 to be vertically slidable, and is provided with a double nut 43*a* at an upper portion thereof. The support rod 43 is biased upward by the support spring 45 via a washer 43*b*. The spring force of the support spring 45 is set at a spring force to bias the support 42 upward against a downward force exerted by the total weight of a pair of bottom dies 21 and 22, the first stopper 51, the second stopper 52, the support plate 41, the bottom support 42, the four support rods 43, and the thick-walled pipe material 111*a* that will be described later. FIG. 3 shows the state in which a ram 80 is lifted upward, and in this state, the support plate 41 is lifted upward by the force of the spring 45, and abuts to a bottom surface of the base plate 34*a*. Further, in this state, upper corner portions 42*a* and 42*a* of the bottom support 42 abut to a lower surfaces 20*g* and 20*g* of a pair of the bottom dies 21 and 22 to support a pair of the bottom dies 21 and 22 so that they don't move downward.

As shown in FIG. 5 being a sectional view taken along the line 5—5 in FIG. 1, the side press devices 60 and 60 placed on both sides of the presser die 12 each have a side die 61, a side guide 62 and a guide cover 63. The side die 61 is inserted into a side press hole 67*g* provided in a longitudinal side face of a side guide 67, and is attached so as not to be removed from the side guide 67 with a plug 65 screwed into a thread portion of the side press hole 67*g*. A side spring 66 is inserted into the side press hole 67*g* by being compressed between a step portion 67*h* and a flange portion 61*a* of the side die 61 to bias the side die 61 to an outward direction from the side guide 67.

The side guide 62 is provided with an inclined surface 62*a*, which is closer to the side guide 67 as it is extending downward. The side guide 62 is attached to a side support 64 with a bolt not shown. Guide covers 63 are attached to both sides of the side supports 64 with bolts not shown. The side support 64 is attached to the base frame 34 with a bolt not shown. An outer end surface 61*b* of the side die 61 is an inclined surface in an up and down direction, and flat surface portions 61*c* are provided at the outer end portion of the side dies 61 on both sides. An inner end surface 61*d* of the side die 61 is a vertical flat surface so as to press a side surface of the pipe material 111*a* to form flat surface portions 111S and 111S to which a spanner is applied on both sides of a center portion of the pipe material 111*a*.

The side guide 67 penetrates through the base plate 34*a* of the base frame 34 to be vertically slidable toward a lower position, and further penetrates through the support plate 41 to be vertically slidable. The side guide 67 is caught at an underside surface of the support plate 41 by a side guide flange 67*a* so that it is not removed upward. The side guide 67 has a spring chamber 67*b* from an underside surface thereof toward an upper position, and a side spring 68 is inserted in an inside thereof. The side spring 68 is provided on a top surface of a bottom base plate 34*b* of the base frame 34 and biases the side guide 67 upward to press it upward.

Next, according to a forming method of the thick-walled pipe material 111*a*, an operation of the embodiment will be explained.

Figure 6A:
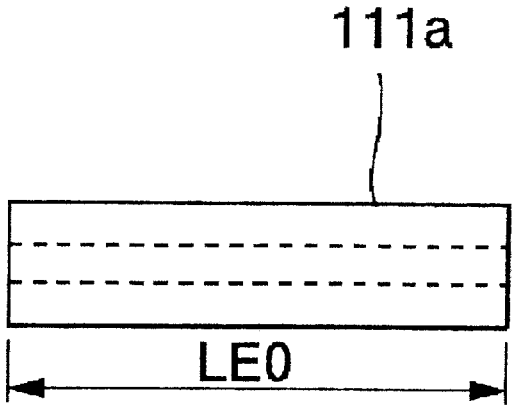
FIG. 6A and FIG. 6B are views showing forms of a thick-walled elbow material according to the embodiment of the present invention.
Figure 7A:
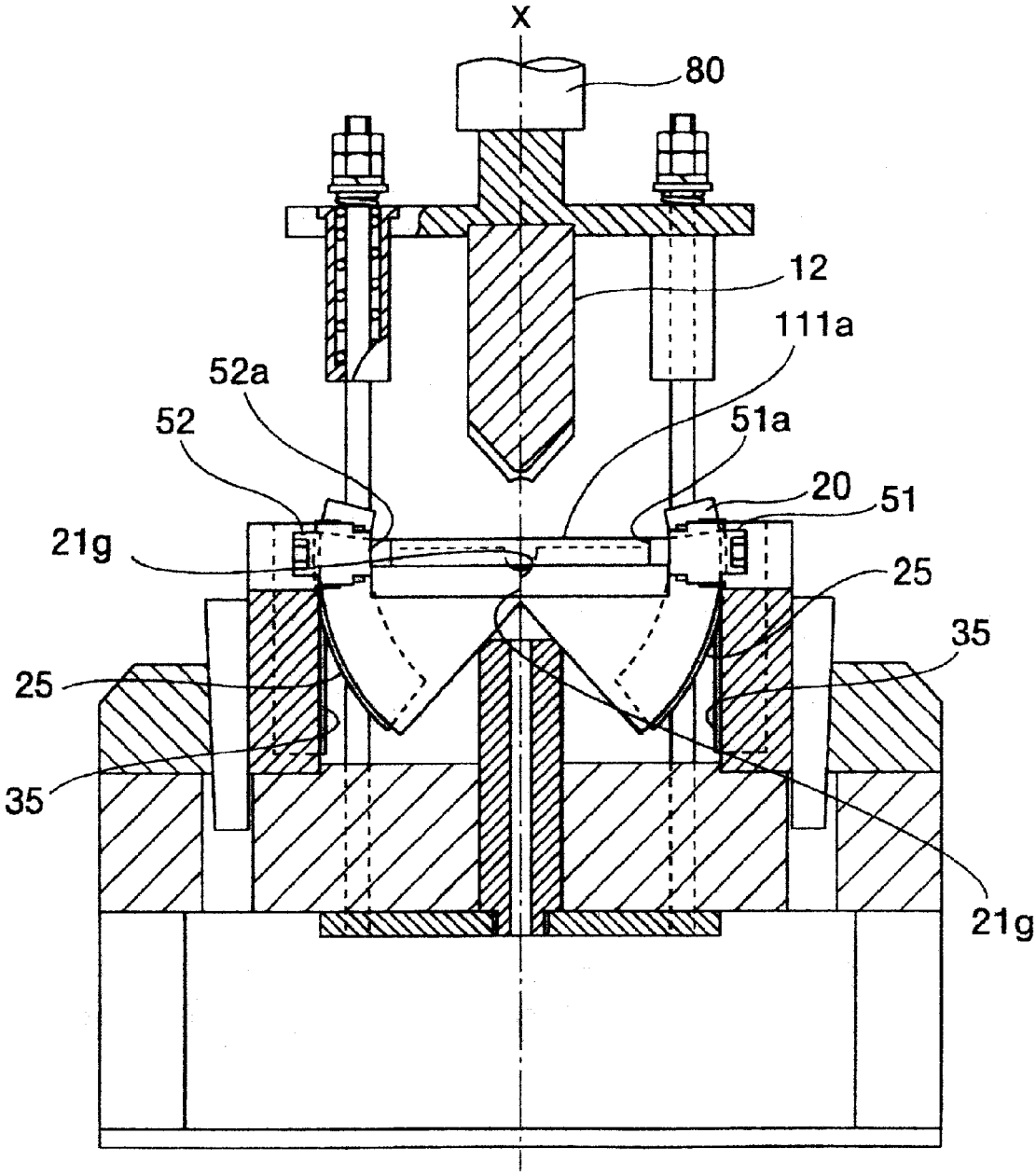
FIG. 7A through FIG. 7E are explanatory views of a work process according to the embodiment of the present invention.

First, a predetermined length LEO of the metal thick-walled pipe material 111*a* (hereinafter, called the pipe material 111*a*) being a material to be formed as shown in FIG. 6A is cut at a right angle to a longitudinal direction. Subsequently, as shown in FIG. 7A, the ram 80 is fixed at a rising end position, and the pipe material 111*a* is placed on the lower die 20 in the state in which the presser die 12 is at a rising position. In this state, the end surfaces 2l*g* and 22*g* of the lower dies 21 and 22 abut to each other on the vertical center line X, and the circular arc racks 25 and 25 and the straight-line racks 35 and 35 are meshed with each other. The upper corner portions 42*a* and 42*a* of the lower support 42 abut to the lower surfaces 20*g* and 20*g* of a pair of the bottom dies 21 and 22 to support a pair of the bottom dies 21 and 22 so that they do not move downward.

According to the above, a pair of the bottom dies 21 and 22 are in the stabilized state. Accordingly, since the lower die 20 does not move, the pipe material 111*a* can be easily set. A tip end portion of the presser die 12 is above the lower die 20, and a sufficient space for placing the pipe material 111*a* on the lower die 20 exists between the tip end portion of the presser die 12 and the lower die 20.

Next, the first stopper 51 and the second stopper 52 are rotated to be screwed in, and the planar end surfaces 51*a* and 52*a* of the first stopper 51 and the second stopper 52 are made to abut to both end surfaces of the pipe material 111*a*, whereby the pipe material 111*a* is fixed. In this case, either one of the first stopper 51 or the second stopper 52 may be previously set at a predetermined position, and the pipe material 111*a* may be fixed by rotating the other one.

Figure 7B:
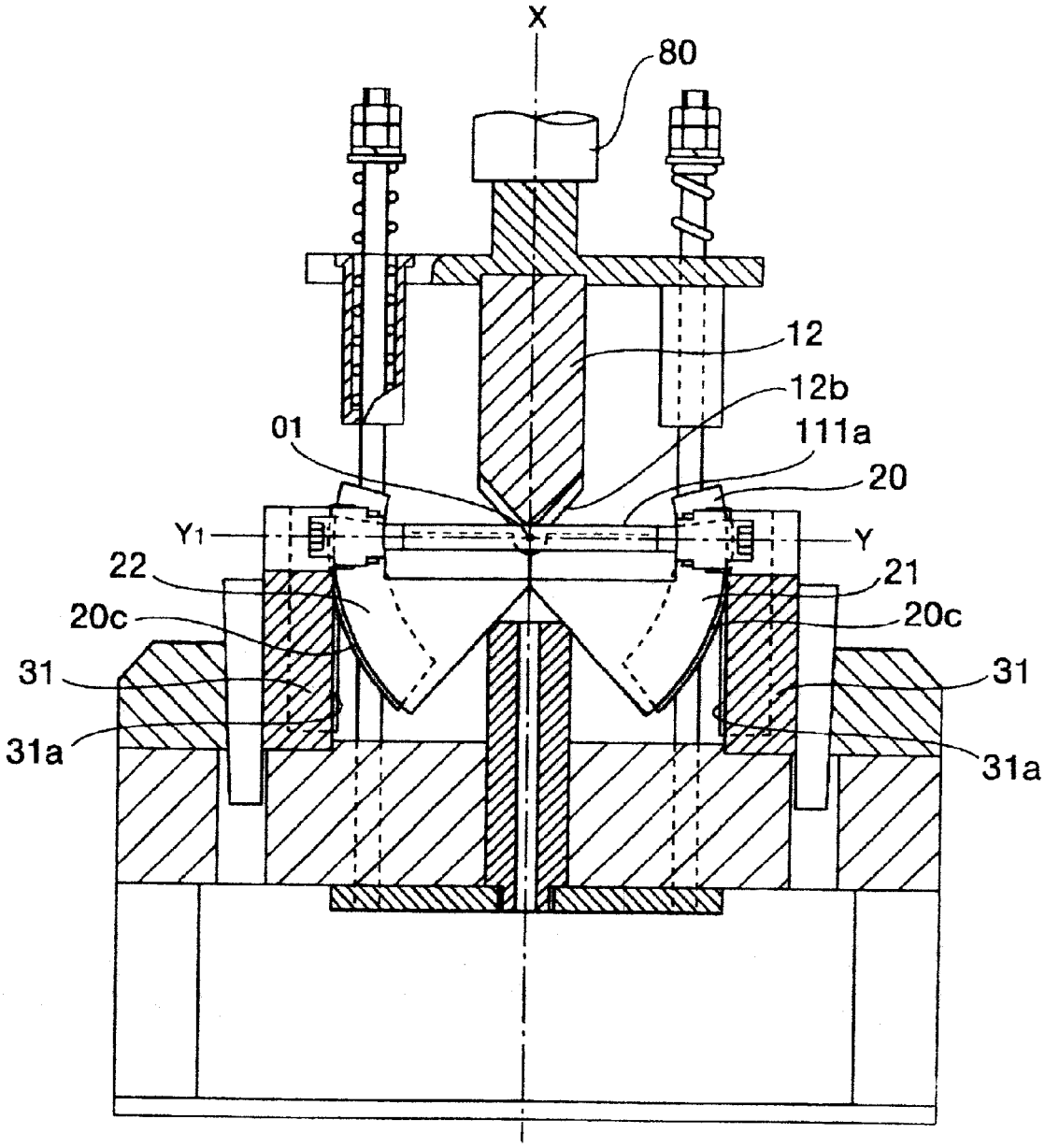

Next, as shown in FIG. 7B, the ram 80 is lowered to lower the presser die 12, and thereby the protruded portion 12*b* of the presser die 12 abuts to a middle portion in a longitudinal direction of the pipe material 111*a*. While the circular arc racks 25 and 25 of a pair of the bottom dies 21 and 22 and the straight-line racks 35 and 35 are meshed with each other, a pair of the bottom dies 21 and 22 rotate around the center O1 as the center in the direction opposite to each other so as to be closer to the vertical center line X, and starts press-bending. The rolling surfaces 20C and 20C in the circular arc form of a pair of the bottom dies 21 and 21 roll on the guide surfaces 31*a* and 31*a* of the guide blocks 31, and receive force from a pair of the bottom dies 21 and 22 respectively.

The center of the pitch radius RLp of the circular arc racks 25*a* of the circular arc racks 25 and 25 of a pair of the bottom dies 21 and 22 corresponds to the center O1 of the radius R1*a* of the rolling surfaces 20*c* and 20*c* of a pair of lower dies 21 and 22. Consequently, the rolling surfaces 20*c* and 20*c* in the circular arc form abut to and roll along the guide surfaces 31*a* and 31*a* of the guide blocks 31 and 31, and thus a pair of the bottom dies 21 and 22 can smoothly rotate around the center O1. The center O1 descends on the vertical center line X.

Figure 7C:
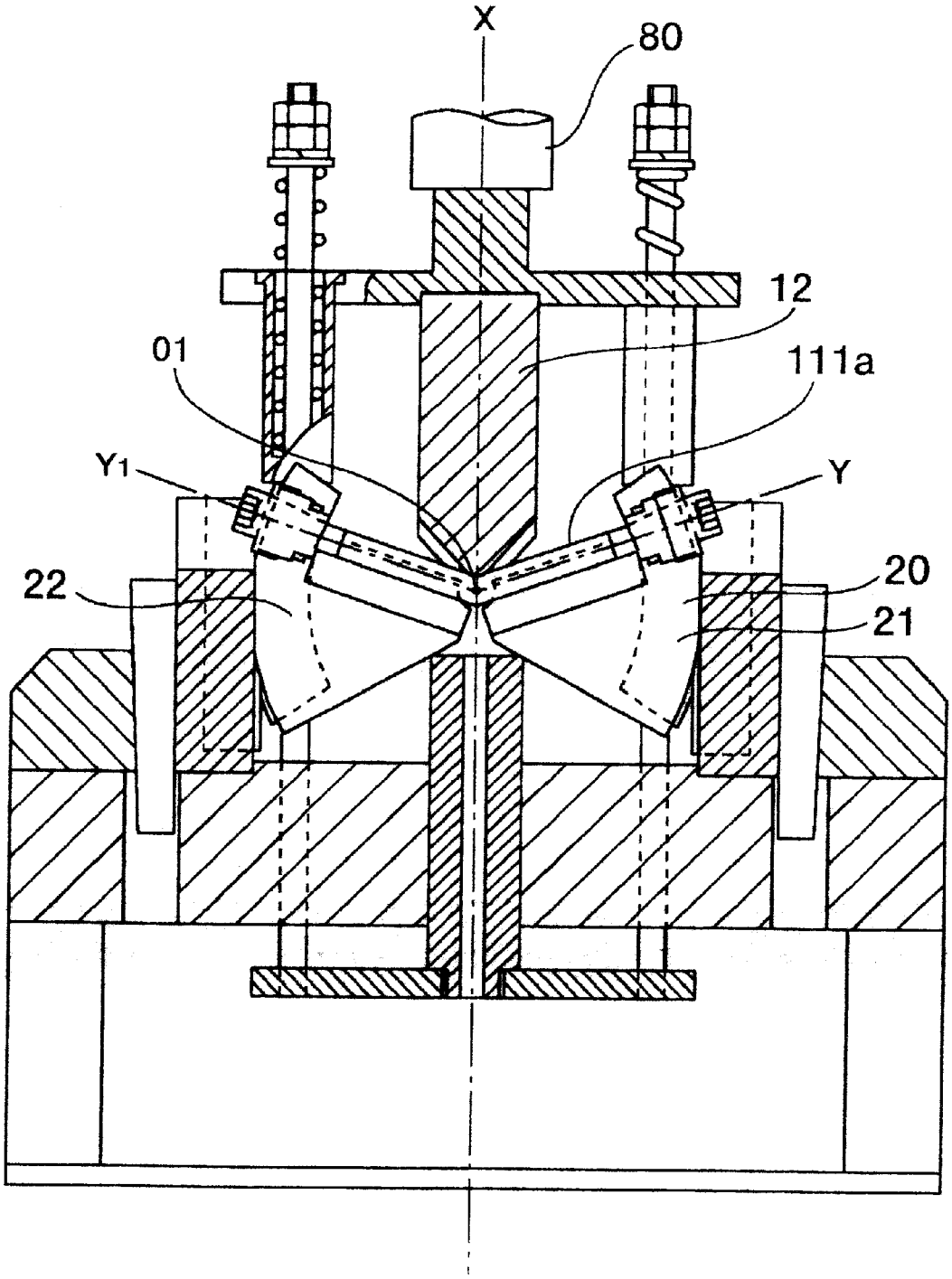

As shown in FIG. 7C, when the ram 80 is further lowered to thereby lower the presser die 12, in connection with this, a pair of the bottom dies 21 and 22 rotate along the circular arcs with the center O1 as their center in the opposite directions to each other while the circular arc racks 25 and 25 and the straight-line racks 35 and 35 are meshed with each other. Further, the respective rolling surfaces 20*c* and 20*c* of a pair of the bottom dies 21 and 22 abut to and roll along the guide surface 11*a* of the guide blocks 31 and 31. Then a pair of the bottom dies 21 and 22 face to each other so as to have the center O1 of rotation on the vertical center line X respectively, and they rotate so that a relative angle made by the upper surfaces is made smaller.

When the presser die 12 is further lowered, the lower surfaces 20*g* and 20*g* of a pair of the bottom dies 21 and 22 abut to the upper surface 34*c* of the base frame 34. Then, the presser die 12 stops descending with the upper surface 34*c* of the base frame 34 serving as the stopper.

Figure 7D:
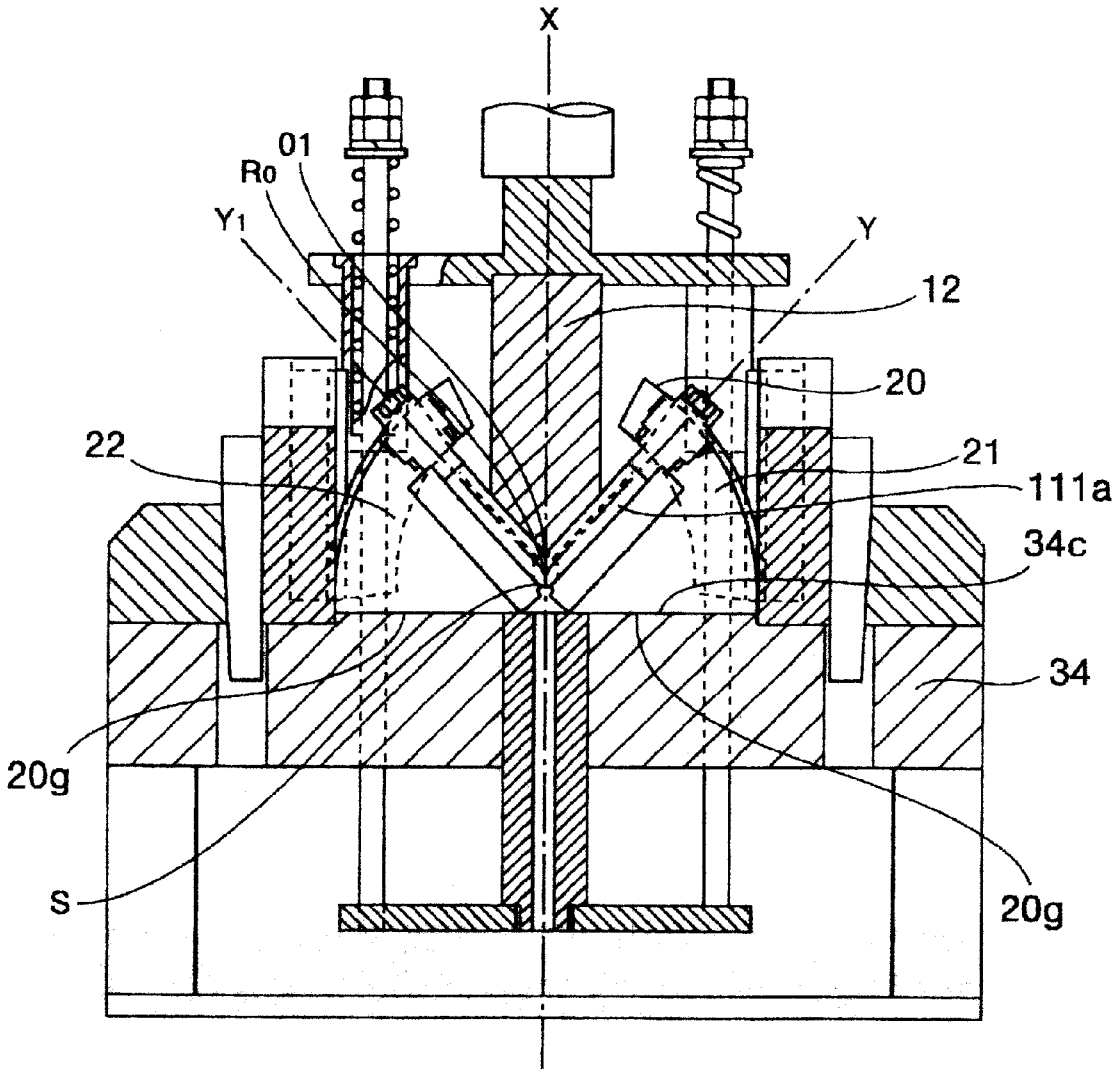

A center line Y of the pipe material 111*a* passes through the center O1 of rotation at the time of start of the bending as shown in FIG. 7B. As shown in FIG. 7D, when the bending proceeds, the center line Y curves to be a curved line S having a very small radius R0 of, for example, 12 mm, in the vicinity of the center O1 with the center O1 of rotation being as a boundary, and connects to a center line Y1, and the bent angle approaches a right angle. In this situation, the center line Y and the center line Y1 rotate with a point of intersection thereof being the center O1 so that an angle formed by the center line Y and the center line Y1 becomes small.

The pipe material 111*a* is pressed and crushed by the presser die 12 by bending, whereby thickness at a center portion in a longitudinal direction of the pipe material 111*a* on the upper side from the center line Y and the center line Y1 is compressed, and thickness at the center portion in the longitudinal direction of the pipe material 111*a* on the lower side from the center line Y and the center line Y1 is elongated. Thus, the thickness at the compressed side tries to move to the elongated side on the lower side from the center line Y and the center line Y1, but the grooves 20*a* and 20*a* with the circular arc sections of the lower die 20 restrain it so that the thickness cannot move to any other places and thus tries to move in the longitudinal direction of the pipe material 111*a*.

The pipe material 111*a* then tries to extend in the longitudinal direction, but the planar end surfaces 51*a* and 52*a* of the first stopper 51 and the second stopper 52 work as the stoppers for both end surfaces of the pipe material 111*a* and restrain the movement of the thickness of the pipe material 111*a*.

Figure 6B:
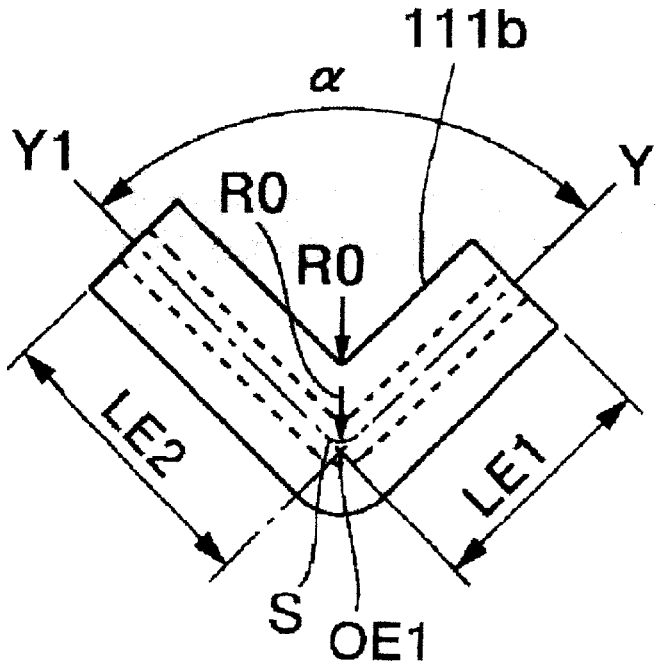

Accordingly, as shown in FIG. 7D, the pipe material 111*a* is bent so that its center line becomes the center line Y, from which it becomes the curved line S, and then it becomes the center line Y1. As the result, the center line of the pipe material 111*a* becomes the center line Y, from which it becomes the curved line S with the radius R0 near the intersection point OE1 of the center line Y and the center line Y1, and then it connects to the center line Y1 as shown in FIG. 6B. Thus, the thick-walled elbow material 111*b* having a predetermined bent angle α with predetermined lengths LE1 and LE2 from both the end surfaces to the intersection point OE1 is formed. On the bending work, the intersection point OE1 of the center line Y and the center line Y1 corresponds to the center O1 of rotation. Specifically, the pipe material 111*a* is accurately formed to be in a size set by the first stopper 51 and the second stopper 52.

Figure 8:
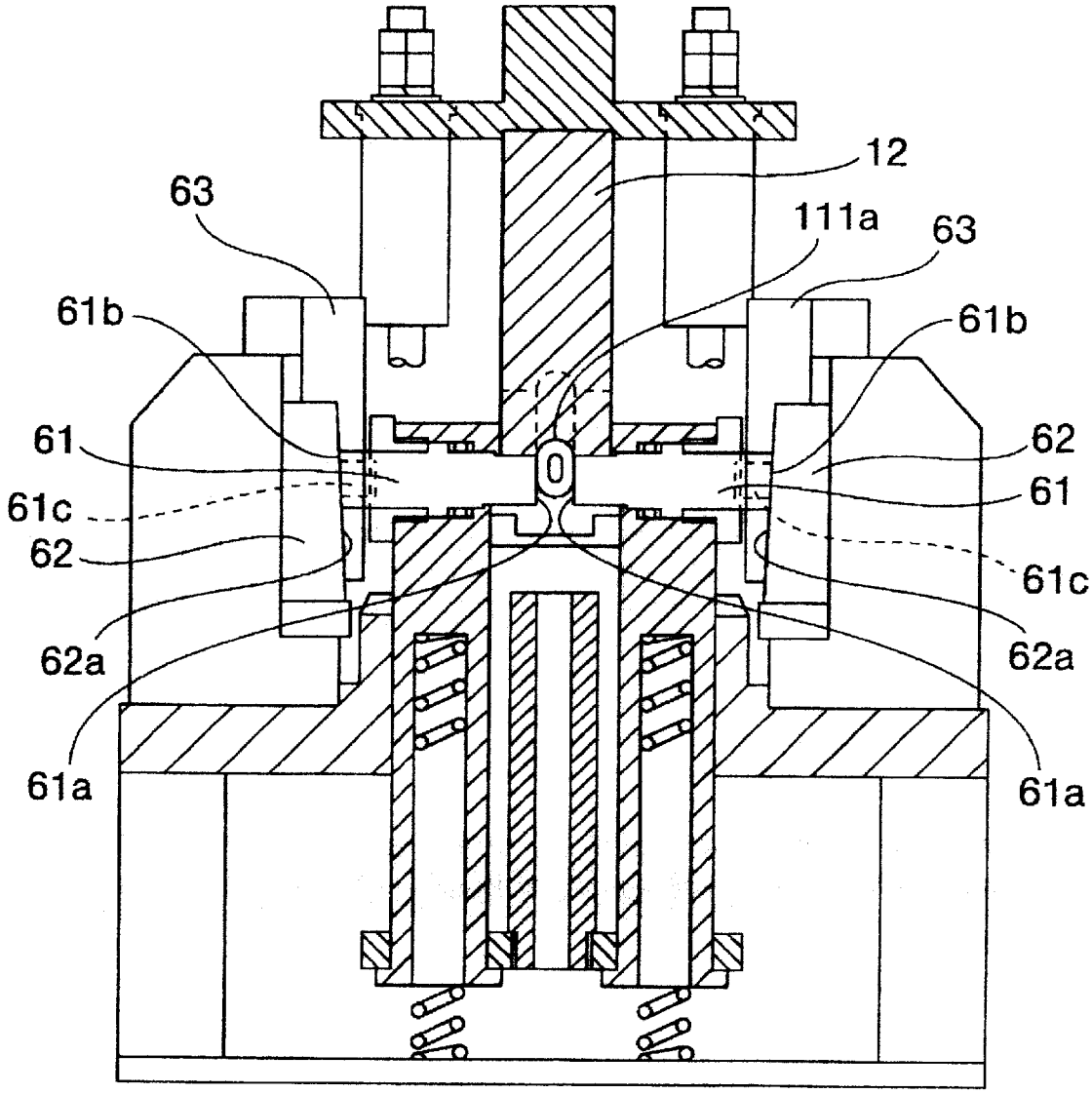
FIG. 8 is an explanatory view of side press devices in a state in which the presser die descends in the work process according to the embodiment of the present invention.

When the presser side 12 lowers, in the side press devices 60 as shown in FIG. 8, the tip ends of the side dies 61 are pressed downward by the presser die 12, and the outer end surfaces 61*b* of the side dies 61 contact the inclined surfaces 62*a* of the side guides 62 of the side dies 61 and are pressed inward. Thereupon, the end surfaces 61*a* of the side dies 61 press the side surfaces of the pipe material 111*a*, and thus, the flat surface portions 111S and 111S to which a spanner is applied can be formed at both sides of the center portion of the pipe material 111*a*. The flat surface portions 61*c* at both sides of the outer end portions of the side dies 61 touch the guide covers 63 attached at both sides of the side supports 64, and therefore the side dies 61 slide to descend without rotating.

Next, the first stopper 51 and the second stopper 52 of the stopper 50 are rotated to be loosened, whereby the planar end surfaces 51*a* and 52*a* of the first stopper 51 and the second stopper 52 are separated from both the end surfaces of the pipe material 111*a*. In this case, either one of the first stopper 51 or the second stopper 52 may be loosened.

Figure 7E:
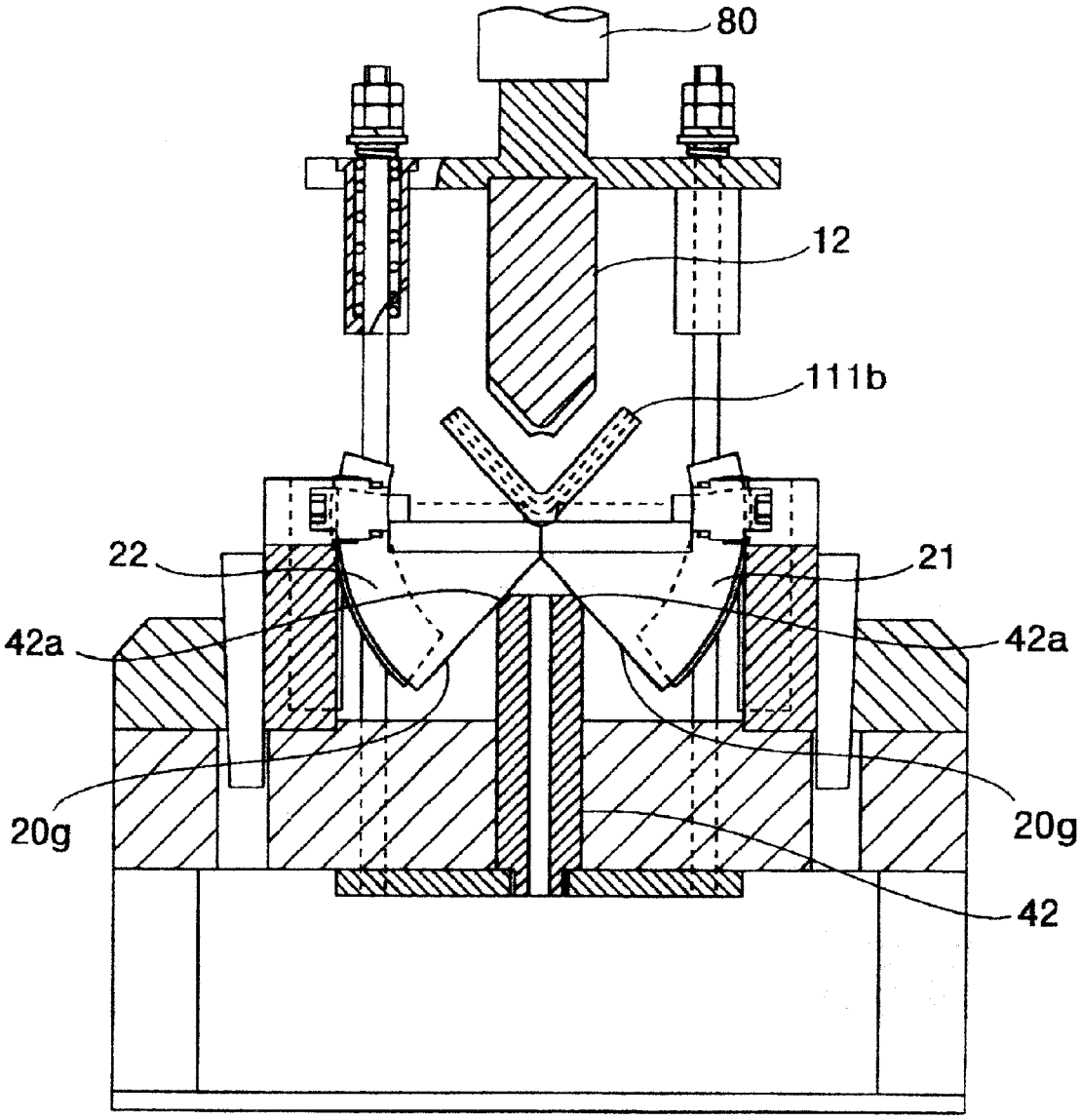

Next, the ram 80 is raised to raise the presser die 12 to establish the situation as shown in FIG. 7E. In this situation, the presser die 12 rises, and in connection with this, the bottom support 42 abuts to the lower surfaces 20*g* and 20*g* of a pair of the bottom dies 21 and 22 to press a pair of the bottom dies 21 and 22 upward. Further, the upper corner portions 42*a* and 42*a* of the bottom support 42 abut to the lower surfaces 20*g* and 20*g* of a pair of the bottom dies 21 and 22 to support a pair of the bottom dies 21 and 22 so that they don't move downward, whereby a pair of the bottom dies 21 and 22 are in a stabilized state. Subsequently, the thick-walled elbow material 111*b* after being formed is taken out.

Accordingly, since the thick-walled pipe material 111*a* is restrained by the presser die 12, a pair of the bottom dies 21 and 22, the first stopper 51 and the second stopper 52 to be formed, it can be accurately formed into the thick-walled elbow material 111*b* in a predetermined size and shape. The pipe material 111*a* may be placed on the lower die 20 to be subjected to bending work after it is heat-treated.

Further, on the bending work, the point of intersection of the center line Y and the center line Yl of the pipe material 111*a* is on the center O1 being the center of rotation of a pair of the bottom dies 21 and 22 of the lower die 20. Accordingly, regarding the bottom dies 21 and 22 and the pipe material 111*a*, the relative positions in the longitudinal direction on the center lines Y and Y1 do not change even if a pair of the bottom dies 21 and 22 rotate. In other words, when the bottom dies 21 and 22 rotate, the pipe material 111*a* is pressed against a pair of the bottom dies 21 and 22 by pressing force of the presser die 12. As a result, frictional force works between the pipe material 111*a* and the bottom dies 21 and 22, and the frictional force works so that the distance between the positions of both the end surfaces of the pipe material 111*a* and the center O1 are not changed.

Accordingly, both the end surfaces of the pipe material 111*a* are restrained in the range of the aforesaid frictional force with respect to the center O1, thus reducing the change in the size of the pipe material caused by bending at the start and the completion of bending work. As a result, even if the first stopper 51 and the second stopper 52 are not provided, the thick-walled elbow material 111*b* with less variations in the size of predetermined lengths LE1 and LE2 from the point of intersection OE1 of the center lines Y and Y1 to both the end surfaces can be formed.

It is possible to set the bent angle α of the pipe material 111*a* optionally by adjusting a descending stroke of the presser die 12. Accordingly, not only the thick-walled elbow material 111*b* bent at a right angle but also the thick-walled elbow material 111*b* with the bent angle α of 45 degrees or 60 degrees can be manufactured, and therefore many kinds of thick-walled elbow materials 111*b* can be manufactured with one kind of dies.

Figure 9:
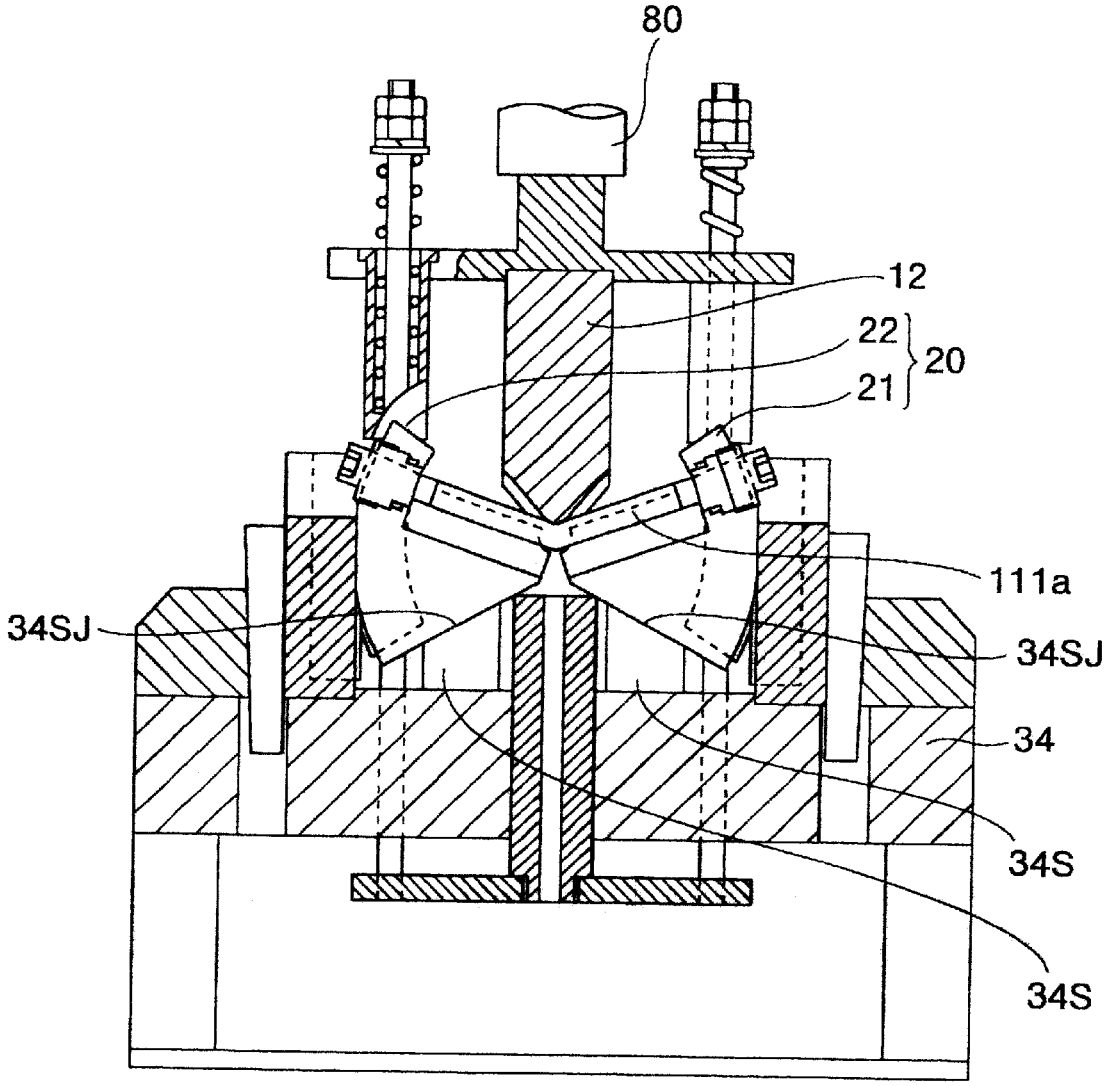
FIG. 9 is a sectional view showing another apparatus for manufacturing a thick-walled bent pipe according to the embodiment of the present invention.
Figure 10:
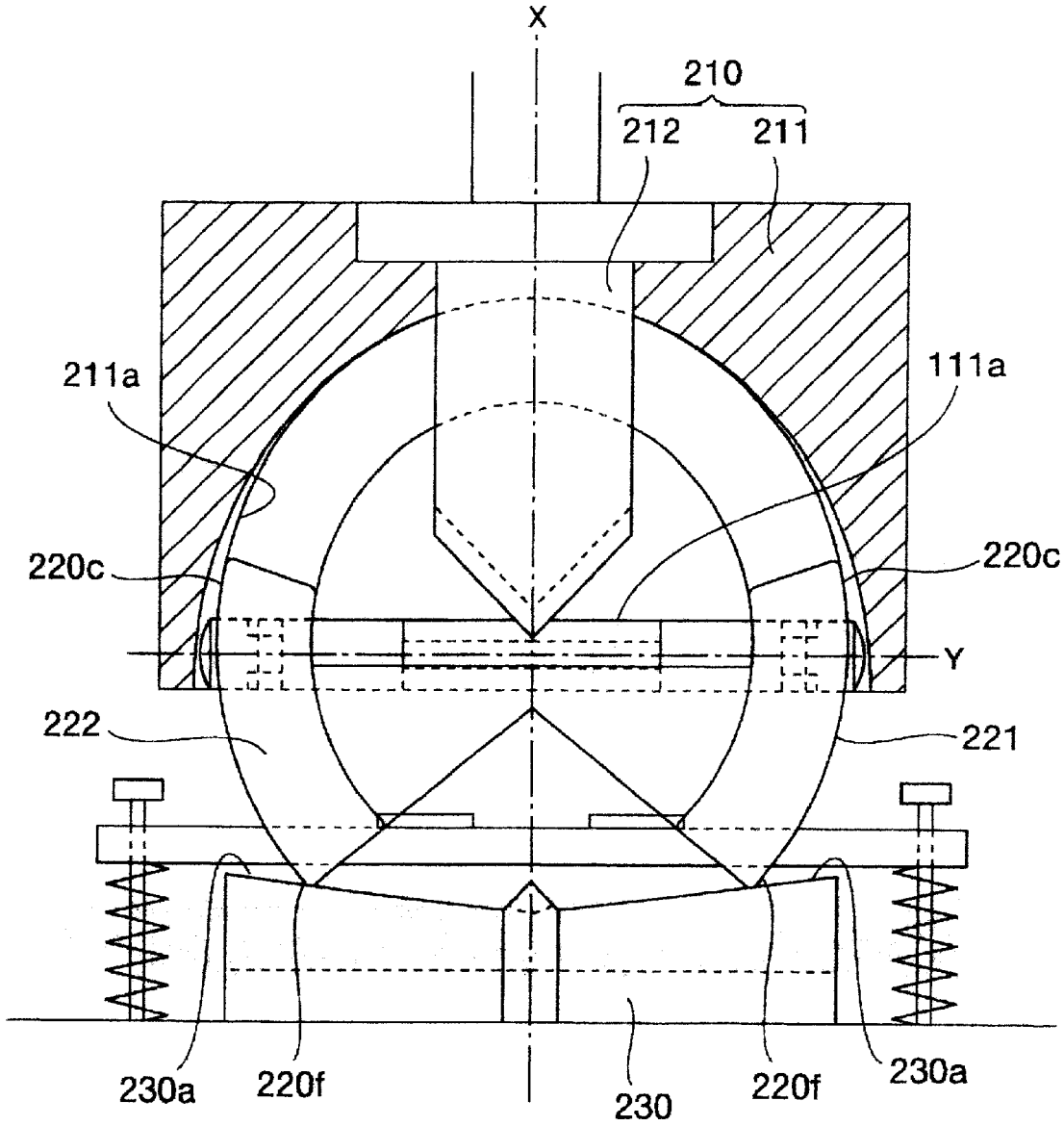
FIG. 10 PRIOR ART
FIG. 10 is an explanatory view showing a conventional apparatus for manufacturing a thick-walled bent pipe.
Figure 11:
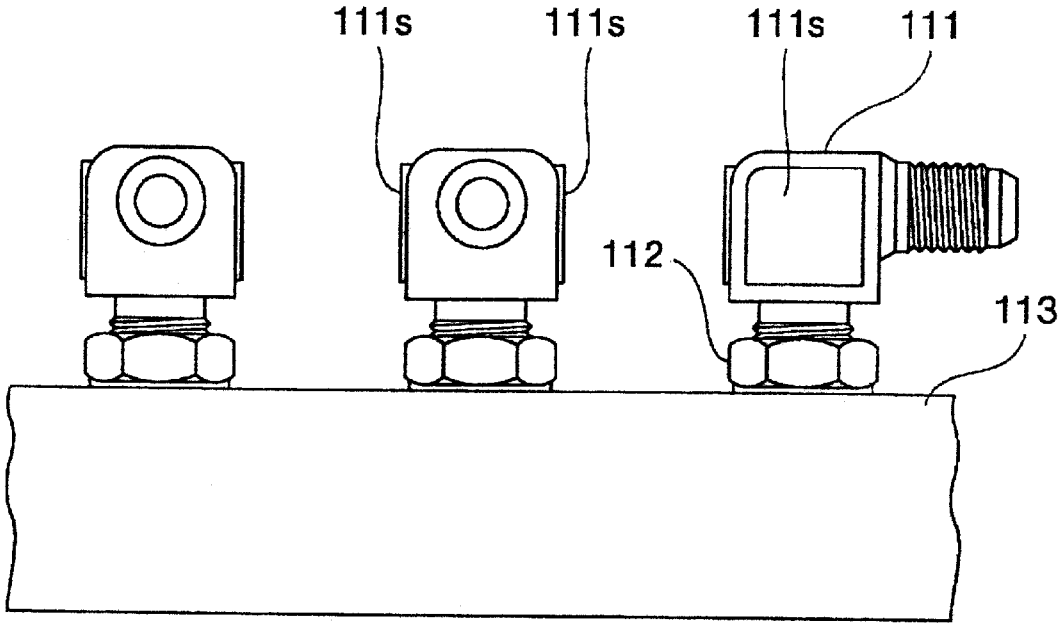
FIG. 11 PRIOR ART
FIG. 11 is an explanatory view showing a conventional piping elbow.
Figure 12:
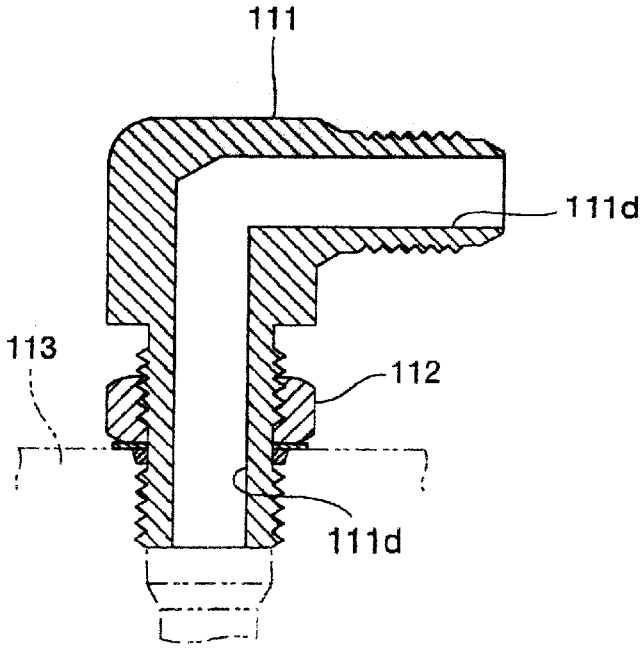
FIG. 12 PRIOR ART
FIG. 12 is a sectional view of the elbow in FIG. 11.

As shown in FIG. 9, the base frame 34 may be provided with bent angle setting stoppers 34S and 34S for setting a bent angle with top surfaces 34SJ being inclined. Thereby, when the presser die 12 is lowered, the lower surfaces 20*g* and 20*g* of a pair of the bottom dies 21 and 22 abut to the top surfaces 34SJ and 34SJ of the bent angle setting stoppers 34S and 34S. Then, the presser die 12 stops descending as the bent angle setting stoppers 34S and 34S serve as stoppers. If a plurality of kinds of the bent angle setting stoppers 34S and 34S are prepared and replaced, the bent angle α of the pipe material 111*a* can be set at predetermined bent angles.

A plurality of the first stoppers 51 and second stoppers 52 with the length Ls1 and Ls2 being varied respectively may be prepared, and by properly selecting and using them, the sizes of the predetermined lengths LE1 and LE2 of the thick-walled elbow material 111*b* can be set optionally. Accordingly, by only replacing the first stopper 51 or the second stopper 52, various kinds of thick-walled elbow materials 111*b* can be manufactured with use of one kind of dies.

As a concrete example according to the apparatus and method for manufacturing the thick-walled bent pipe of the present invention, 60 mm of a thick-walled pipe material of high-carbon steel, with a diameter of 20 mm and thickness of 7 mm was cut out and used as the pipe material 111*a*. After the portion to be bent of the pipe material 111*a* was heat-treated at about 1000° C., bending work was performed at the bending angle of 90 degrees. As the result, crushing of the inner diameter portion almost did not occur, the thick-walled elbow material 111*b* excellently formed in the accurate size with the predetermined length LE1 of 35 mm and LE2 of 25 mm was obtained.

As explained thus far, according to the apparatus for manufacturing the thick-walled bent pipe of the present invention, the circular arc racks 25 and 25 and the straight-line racks 35 and 35 being the meshing means 30 can be prepared only by working a plate, and therefore only a small amount of work is required, thus reducing the production cost of the manufacturing apparatus. Further, according to the method for manufacturing the thick-walled bent pipe by means of the manufacturing apparatus, the manufacturing cost of the thick-walled elbow material 111*b* being a thick-walled bent pipe is reduced. The circular arc racks 25 and 25 and the straight-line racks 35 and 35 in a plate form only need to be attached to the bottom dies 21 and 22 and the guide block 31 and 31, thus simplifying the structure. In addition, the weight of the circular arc racks 25 and 25 and the straight-line racks 35 and 35 in a plate form is small, which makes them convenient in handling. Further, the circular arc racks 25 and 25 and the straight-line racks 35 and 35 have the gears meshed with each other, and have no sliding portions, and therefore they are hardly worn or seize, thus increasing durability. In other words, the manufacturing apparatus of the thick-walled bent pipe of the present invention is low in production cost with a simple structure and durability, and can manufacture a piping elbow material with high size accuracy with use of a thick-walled pipe material.

Bending work is performed with the pipe material 111*a* being restrained so that it has the length set by the presser die 12, the lower die 20 and the stopper 50 of the lower die, thus making it possible to form the thick-walled elbow material 111*b* of an accurate size. As a result, a thick-walled pipe is cut and used as a material for an elbow, and therefore it is not necessary to prepare forged materials. Further, since a thick-walled pipe can be used, drilling work for making a slender hole for forming a fluid passage is not needed, and deburring at the cross section of the drilled holes, which is conventionally performed, is not needed. Further, a round thick-walled pipe in the outer shape is provided, and thus cutting margin for threading work is reduced. Accordingly, the special drill is not required, and drilling work and deburring work are not required, which reduces a cutting amount of threading work, thus making it possible to shorten the work time to a large extent, reduce tool cost, and improve yield of a material.

The hole in the thick-walled elbow material 111*b* thus formed is not a drill-hole which is crossed as in the prior art, but is a smoothly curved hole, thus making it possible to reduce the pressure loss of a fluid passing through the elbow.

Further, the bent angle α can be set at will by adjusting the descending stroke of the presser die 12, thus making it possible to manufacture various kinds of thick-walled elbow materials 111*b* with different bent angles α. Since a pair of the bottom dies 21 and 22 of the lower die 20 are supported by the bottom support 42 with stability, the bottom dies 21 and 22 do not move, and therefore the thick-walled pipe material 111*a* can be easily set. In addition, the thick-walled elbow material 111*b* is easily taken out, and therefore the thick-walled elbow material 111*b* can be efficiently manufactured.

The pipe material 111*a* can be accurately formed to be the thick-walled elbow material 111*b* of a size set by the first stopper 51 and the second stopper 52. Further, by replacing the first stopper 51 and the second stopper 52 with those with different lengths, various kinds of thick-walled elbow materials 111*b* of different sizes can be manufactured with one kind of dies.

Since the end surfaces 61*a* of the side dies 61 of the side press devices 60 press the side surfaces of the pipe material 111*a*, the flat surface portions 111S and 111S to which a spanner can be applied can be formed at both sides of the center portion of the pipe material 111*a*. Accordingly, assembly can be performed with a spanner being surely applied onto the flat surface portions 111*s* and 111*s* as necessary, and thus the thick-walled elbow material 111*b* with further improved assembly easiness can be manufactured.

What is claimed is:

1. An apparatus for manufacturing a thick-walled bent pipe comprising:

a presser die;

a lower die movably attached to a stationary portion of said apparatus, said lower die including a pair of bottom dies having means for meshing with means to be meshed which is secured to said stationary portion of said apparatus and biasing means for pressing the pair of bottom dies upward by a resilient force such as a spring force or the like;

wherein, at the time of formation, the pair of said bottom dies are caused to rotate opposite to each other about a single center point from an initial position as said means for meshing meshes with the means to be meshed, with a descent of said presser die to perform the formation and, after the formation is finished, the pair of bottom dies are pressed upward by the biasing means and caused to rotate opposite to each other about the single center point as said means for meshing meshes with the means to be meshed, with an ascent of said pressure die, to thereby return to the initial position.

2. The apparatus for manufacturing the thick-walled bent pipe in accordance with claim 1, further comprising side press devices which include:

a side guide having a slope that slants more inwardly as it goes downward;

a side die that is guided by the slope of the side guide, the side die having outer side surfaces that slide on the slope of the side guide and flat-shaped inner side surfaces that serve to form side surfaces of a material to be formed, and being biased in an outer side direction of the side guide; and posture holding means for holding a posture of the side die, wherein the side die of the side press device is pressed downward by the pressure die and guided as the outer side surfaces slide on the slope of the side guide to press the side surfaces of the material to be formed by the inner side surfaces to thereby form the material to be formed into a flat shape.

3. The apparatus for manufacturing the thick-walled bent pipe in accordance with claim 1, wherein the pair of bottom dies are provided with stoppers abutting to both end surfaces of a material to be formed in a longitudinal direction of the material to be formed for positioning end surfaces of said manufactured thick-walled bent pipe.

4. The apparatus for manufacturing the thick-walled bent pipe in accordance with claim 3, further comprising said press devices which include:

a side guide having a slpe that slants more inwardly as it goes downward;

a side die that is guided by the slpe of the side guide, the side die having outer side surfaces that slide on the slpe of the side guide and flat-shaped inner side surfaces that serve to form side surfaces of a material to be formed, and being biased in an outer side direction of the side guide; and posture holding means for holding a posture of the side die, wherein the side die of the side press device is pressed downward by the pressure die and guided as the outer side surfaces slide on the slope of the side guide to press the side surfaces of the material to be formed by the inner side surfaces to thereby form the material to be formed into a flat shape.

5. A method for manufacturing a thick-walled bent pipe, comprising the steps of:

placing a thick-walled metal pipe material of a predetermined length on a lower die comprising a pair of bottom dies moveably attached to a stationary portion of a bending apparatus, said pair of bottom dies having means for meshing with means to be meshed that is secured to said stationary portion of said bending apparatus;

pressing a middle portion in a longitudinal direction of said thick-walled metal pipe material by lowering a presser die, and thereby rotating the pair of said bottom dies opposite to each other about a single center point from an initial position as the means for meshing meshes with the means to be meshed, to form a thick-walled elbow material of a predetermine size; and after the formation is finished, pressing the pair of bottom dies upward by biasing means to cause the pair of bottom dies to rotate opposite to each other about the single center point as the means for meshing meshes with the means to be meshed, to thereby return the pair of bottom dies to the initial position.

6. The method for manufacturing the thick-walled bent pipe in accordance with claim 5, further comprising the step of:

on pressing the middle portion in the longitudinal direction of said thick-walled metal pipe material, providing stoppers at a pair of said bottom dies which abut to both end surfaces of said thick-walled metal pipe material in the longitudinal direction of said thick-walled metal pipe material to restrain both the end surfaces in the longitudinal direction of said thick-walled metal pipe material.

* * * * *